US006417817B1

(12) United States Patent
Pirilä et al.

(10) Patent No.: US 6,417,817 B1
(45) Date of Patent: Jul. 9, 2002

(54) INTEGRATED ANTENNA GROUND PLATE AND EMC SHIELD STRUCTURE

(75) Inventors: Jouko Pirilä, Turku; Mikko Laitinen, Halikko; Mikko Laaksonen, Angelniemi; Eero Jousinen, Salo, all of (FI)

(73) Assignee: Nokia Mobile Phones, Ltd., Espoo (FI)

( * ) Notice: Subject to any disclaimer, the term of this patent is extended or adjusted under 35 U.S.C. 154(b) by 0 days.

(21) Appl. No.: 09/713,765

(22) Filed: Nov. 15, 2000

(30) Foreign Application Priority Data

Nov. 17, 1999 (FI) ..... 19992464

(51) Int. Cl.[7] ..... H01Q 1/24; H01Q 1/52
(52) U.S. Cl. ..... 343/841; 343/702; 343/700 MS
(58) Field of Search ..... 343/702, 841, 343/700 MS; H01Q 1/24, 1/38, 1/52

(56) References Cited

U.S. PATENT DOCUMENTS 5,113,196 A * 5/1992 Ponce De Leon et al. .. 343/744
5,764,190 A 6/1998 Murch et al. ..... 343/702
6,014,113 A * 1/2000 Orchard et al. ..... 343/841
6,031,494 A * 2/2000 Okabe et al. ..... 343/702
6,133,886 A * 10/2000 Fariello et al. ..... 343/702

FOREIGN PATENT DOCUMENTS

WO WO 99/27607 6/1999

OTHER PUBLICATIONS

Patent Abstracts of Japan Publication No. JP 11127010.
Patent Abstracts of Japan Publication No. JP 10032414.
Patent Abstracts of Japan Publication No. JP 10200327.

* cited by examiner

*Primary Examiner*—Hoanganh Le
(74) *Attorney, Agent, or Firm*—Perman & Green, LLP

(57) ABSTRACT

An electromechanical structure is provided for a portable radio device. In comprises a circuit board (302, 401), a number of components (301, 402) attached to the circuit board, a conductive shield (303, 304, 404, 407) for enclosing the components and an essentially planar antenna radiator (305, 410). A part (304, 407) of the conductive shield is essentially planar and adjacent to the antenna radiator (305, 410) in order to function as a ground plane for the antenna radiator.

8 Claims, 3 Drawing Sheets

INTEGRATED ANTENNA GROUND PLATE AND EMC SHIELD STRUCTURE

TECHNOLOGICAL FIELD

The invention concerns generally the technological field of electromechanical implementation of a radio device, like a portable radio transceiver. Especially the invention concerns both antenna structures and the structures that are used for shielding microelectronic components to achieve certain EMC or electromagnetic compatibility.

BACKGROUND OF THE INVENTION

Modern radio transceivers comprise a PCB or printed circuit board onto which a number of microelectronic and radio frequency components are soldered. To shield the components against electromagnetic interference from external sources, and to keep the stray electromagnetic fields generated by the components from causing interference elsewhere, the electromechanical structure of the radio transceiver must define a number of enclosures with conductive walls that surround the components and have good contacts to the general ground potential level of the radio transceiver. A number of lead-ins are provided in the walls to pass signals in a controlled way between the components of the radio transceiver.

FIG. 1 is an exploded cross-sectional view that shows schematically a known structural arrangement which is built on a PCB 101 with a number of contact strips 102 and contact pads 103 on its upper surface. FIG. 2 shows the same structure in an assembled position. Microelectronic and radio frequency components 104 are soldered onto contact pads 103 and surrounded by a conductive frame 105 which comes into contact with conductive, grounded strips 102 on the surface of the PCB 101. A planar lid 106 is placed on top of the frame 105 and attached into place by soldering or by other means. An outer cover 107 protects the whole arrangement and gives it a desired outer appearance.

FIGS. 1 and 2 show also a known way of building an internal antenna to the radio transceiver. The antenna type in question is the well-known PIFA or Planar Inverted-F antenna which comprises on the surface of the PCB a ground plane 108, a grounding pad 109 (which may also be an integral part of the ground plane) and a feeding pad 110 from which there is a transmission line (not shown) to a duplex filter or other radio frequency component that forms the part of the radio transceiver which in the signal propagation sense is closest to the antenna. The PIFA structure comprises further a planar radiator 111 from which there extend a grounding pin 112 and a feeding pin 113 towards the PCB 101. There are many ways of implementing the planar radiator, of which FIGS. 1 and 2 show a thin conductive sheet that is attached to the inner surface of the outer cover 107. The grounding and feeding pins 112 and 113 are integral with the radiator sheet since they have been cut from the same material and just bent into an essentially 90 degrees angle against the plane of the radiator.

The prior art structure described above involves some problems. For example, the conductive tracks on the PCB that couple the feeding pad 110 to the radio frequency component closest to the antenna become easily relatively long, which causes attenuation and distortion especially to the weak radio frequency oscillations that represent a received signal. Also if soldering or some other difficultly reversed method is used to attach the shielding frame 105 and its lid 106 to each other and to the PCB, it becomes difficult and unproductive to check or service the components within the EMC shielding enclosure if needed.

SUMMARY OF THE INVENTION

It is an object of the present invention to provide an electromechanical structure for a radio transceiver device which combines easy inspection and servicing of components, structural compactness and good protection against electromagnetic interference.

The objects of the invention are achieved by using a single conductive plate at least partly both as a detachable lid for an EMC shielding enclosure and as a ground plate for an antenna.

In its first embodiment the electromechanical structure according to the invention for a portable radio device comprises a circuit board, a number of components attached to the circuit board, a conductive shield for enclosing the components and an essentially planar antenna radiator. In this embodiment the structure is characterized in that a part of the conductive shield is essentially planar and adjacent to the antenna radiator in order to function as a ground plane for the antenna radiator.

In its second embodiment the electromechanical structure according to the invention for a portable radio device comprises an essentially planar antenna radiator and an essentially planar conductive element adjacent to the antenna radiator in order to function as a ground plane for the antenna radiator. In this embodiment the structure is characterized in that the essentially planar conductive element is additionally arranged to function as a part of a conductive shield for enclosing certain electronic components of the portable radio device into an EMC shielding enclosure.

The lid which was formerly used to cover an EMC shielding enclosure is essentially planar, conductive and grounded. Also the antenna ground plate known as such from prior art antenna constructions is essentially planar, conductive and grounded. According to the present invention, structural and functional advantages are gained by using the same essentially planar, conductive and grounded element at least partly both as a lid that covers an EMC shielding enclosure and an antenna ground plate. Not only is it possible to produce the radio transceiver structure with one less part than before, but also PCB space is saved if virtually no extra space has to be allocated to the antenna parts and antenna-related transmission lines. Additionally, if and when the component that is closest to the antenna in the signal propagation sense is placed within this particular EMC shielding enclosure, it becomes very easy to minimize the length of the transmission line between it and the antenna feeding point.

According to an advantageous embodiment of the invention the lid/grounding plate is not separataly soldered or in any way permanently attached to the frame of the EMC shielding enclosure, but it only comes in contact therewith at a certain final assembly stage, preferably the stage where the fully equipped and functionally tested PCB with all electronic and radio frequency parts of the radio transceiver is placed within the appropriate outer cover part. This ensures full serviceability to the components within the EMC shielding enclosure during manufacturing, and even later during the service life of the radio transceiver.

BRIEF DESCRIPTION OF DRAWINGS

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
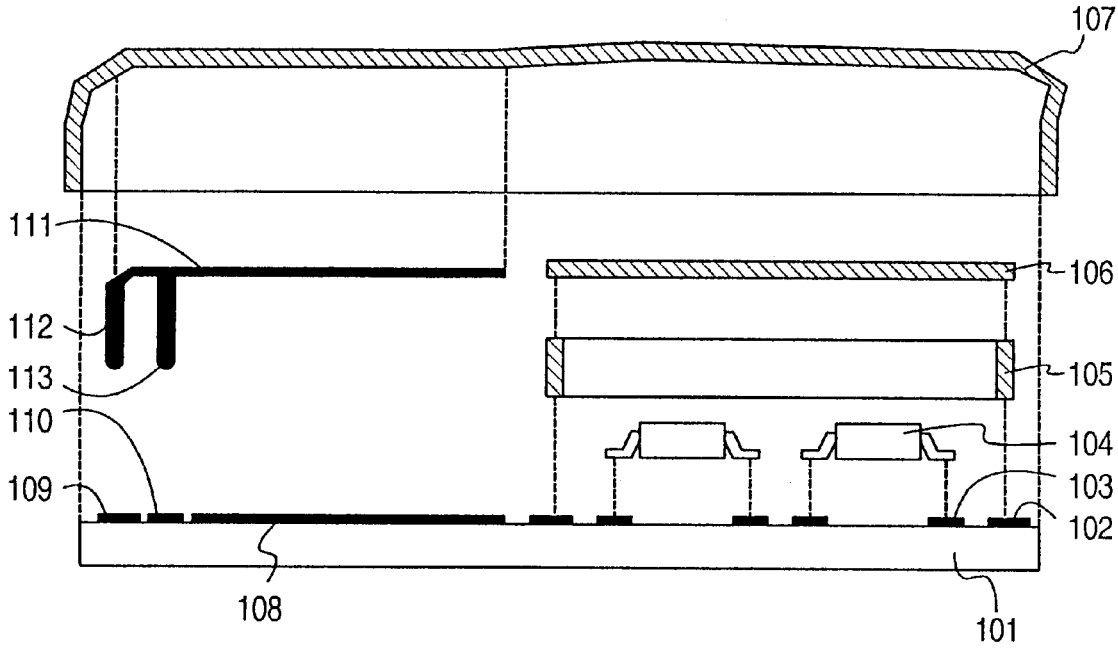
Fig. 1 PRIOR ART
FIG. 1 illustrates a known electromechanical structure in exploded view.
Figure 2:
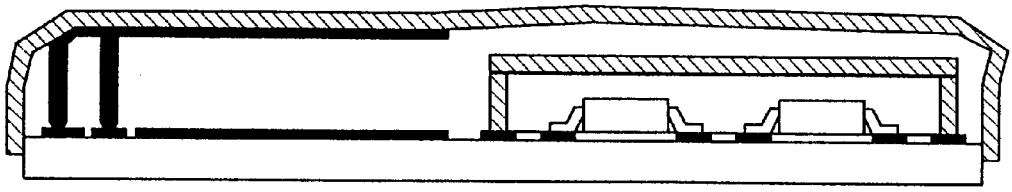
Fig. 2 PRIOR ART
FIG. 2 illustrates the structure of FIG. 1 in assembled position.

The description of prior art explained the features of FIGS. 1 and 2, so the following description of the invention and its advantageous embodiments focuses on FIGS. 3 to 8.

DETAILED DESCRIPTION OF THE INVENTION

Figure 3:
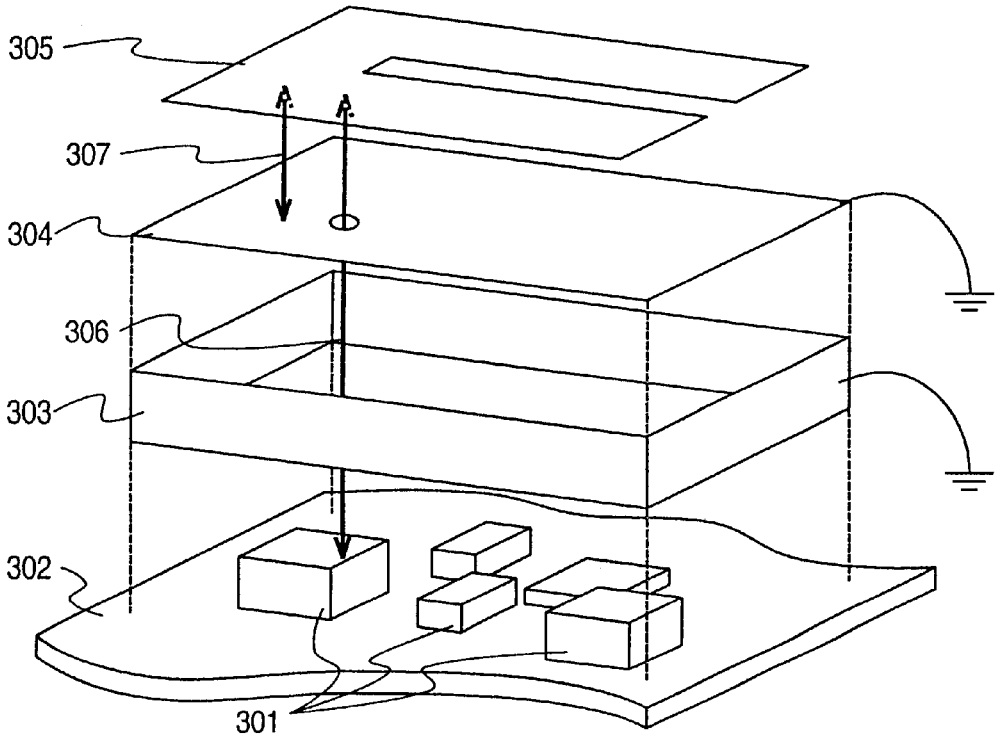
FIG. 3 illustrates the principle of the invention.

FIG. 3 is a schematic diagram that illustrates the mutual positions and attachment to each other of a printed circuit board, certain radio frequency components, a conductive shielding frame, a grounded planar conductive element and a planar antenna radiator in a structure according to an advantageous embodiment of the invention. With certain radio frequency components we mean especially those components of a radio transceiver that are close to the antenna in the signal propagation sense. A non-limiting list of typical such components includes but is not limited to a duplex filter, an antenna switch, a low-noise preamplifier for amplifying received signals, a power amplifier for amplifying signals to be transmitted, mixers for downconverting a received radio frequency signal to an intermediate or baseband frequency and for upconverting a signal to be transmitted into radio frequency, a directional coupler for measuring the power level of a signal to be transmitted, and various filters.

According to the principle shown in FIG. 3, the components 301 are soldered onto a printed circuit board 302. The conductive shielding frame 303 is also attached to the printed circuit board most advantageously by soldering. Also other means known as such for attaching components and a shielding frame onto a PCB may be used. The shielding frame 303 encircles the components 301 on the surface of the printed circuit board 302. A planar conductive element 304 is placed against the protruding edge of the shielding frame 303 preferably without attaching it into place permanently. Potential means for arranging the contact between the shielding frame 303 and the planar conductive element 304 comprise but are not limited to integral contact springs in either or both parts, mechanical snap-joints, matching pairs of bendable protrusions and slots corresponding thereto, and separate clamps that press the parts together. Both the shielding frame 303 and the planar conductive element 304 are grounded, through a common ground path and/or through separate grounding contacts.

The invention does not require any specific overall size for the planar conductive element 304. It is most advantageous if it is at least as large as the area defined by the edge of the shielding frame 303 so that together the shielding frame 303 and the planar conductive element 304 constitute an efficient EMC shielding enclosure for the components 301. It is naturally possible to make a smaller planar conductive element, but to achieve sufficient EMC shielding it is then necessary to additionally use some other essentially planar conductive means to cover the gap thus left open. It is also possible to make the planar conductive element 304 larger than the area defined by the edge of the shielding frame 303 so that at least on one side the planar conductive element extends further.

A planar antenna radiator 305 is placed on that side of the planar conductive element 304 which is not towards the printed circuit board. The planar antenna radiator 305 and the planar conductive element 304 are essentially parallel to each other, and a dielectric layer separates them from each other. The dielectric layer may be air, plastics, ceramics, elastic foam or any other suitably non-conducting material. It is not important whether or not the planar antenna radiator 305 and the planar conductive element 304 are coupled to each other through any support structures.

A coupling for electrical signals is arranged between one of the components 301 and the planar antenna radiator 305. This is schematically shown in FIG. 3 by arrow 306.

Also, if the structure is to implement the PIFA principle, there must be a coupling for electrical signals between the planar antenna radiator 305 and the planar conductive element 304. This is schematically shown in FIG. 3 by arrow 307.

Figure 4:
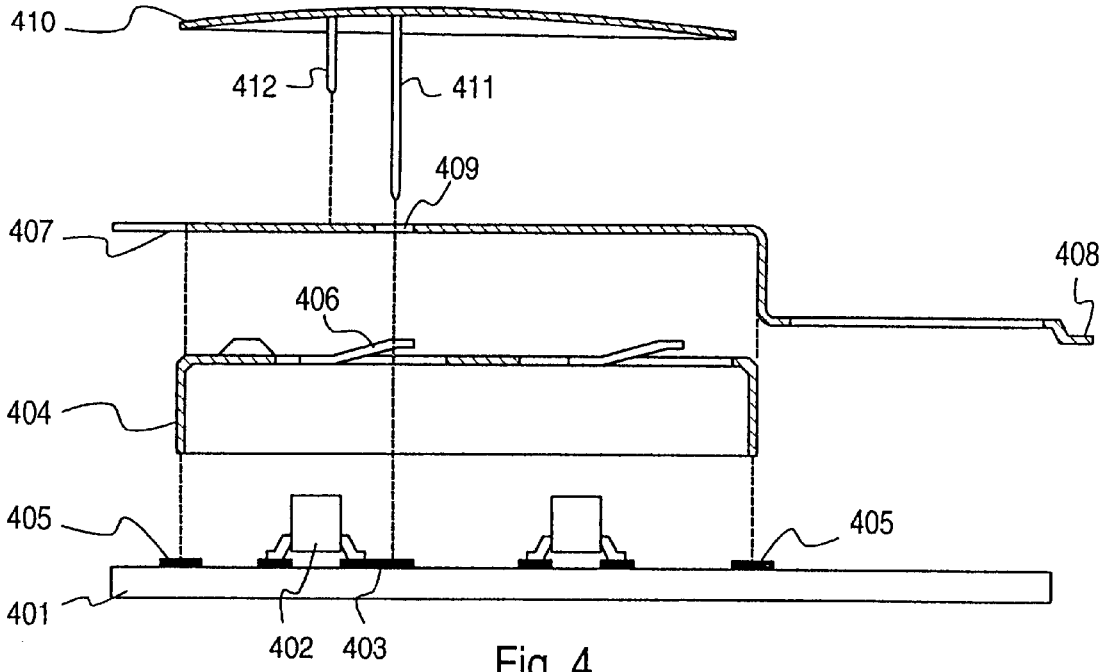
FIG. 4 illustrates a structure according to an embodiment of the invention in exploded view.

FIG. 4 is a partial cross-section and exploded view which illustrates a printed circuit board 401 with certain components soldered thereon. We may suppose that the component closest to the antenna in the signal propagation sense is a duplex filter 402 from one end of which there extends a short transmission line 403 along the surface of the printed circuit board 401. A conductive frame 404 is arranged to be soldered at its lower edges to certain conductive, grounded pads 405 on the surface of the printed circuit board 401. The upper edge of the conductive frame 404 defines a number of contact springs 406 which are made integrally with the rest of the conductive frame from one piece of material: a typical method for manufacturing the conductive frame is a combination of cutting and embossing.

A conductive planar element 407 is also made by cutting and embossing from a thin sheet of metal. It has a certain first planar surface which corresponds in shape and size to the area defined by the upper edge of the conductive frame 404. In the embodiment of FIG. 4 the conductive planar element 407 extends much further than the edge of the conductive frame 404 in one direction, where it contains some bent portions ending at a coupling lip 408. There is at least one hole 409 in the part of the conductive planar element 407 which is to act as a lid for the the conductive frame 404.

An essentially planar antenna radiator 410 is almost as large as the area defined by the upper edge of the conductive frame 404. The slightly curved form illustrated in FIG. 4 is not interpreted as departing from essential planarity. A feeding pin 411 and a grounding pin 412 extend from the planar antenna radiator 410 towards the other parts of the assembly. They may be separately manufactured contact pins or, as in FIG. 4, bent portions of the same thin metal sheet as the rest of the planar antenna radiator 410.

Figure 5:
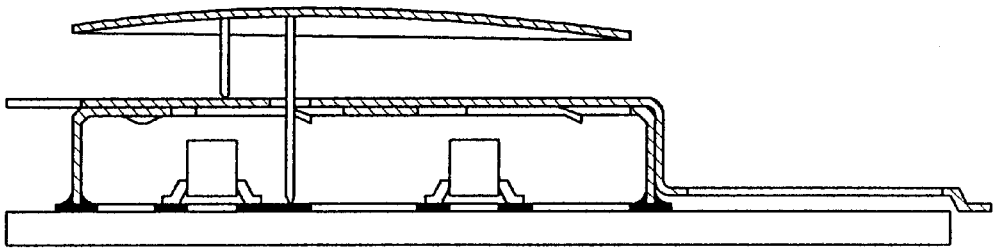
FIG. 5 illustrates the structure of FIG. 4 in assembled position.

FIG. 5 shows the structure of FIG. 4 in assembled position. The feeding pin 411 extends through the hole 409 in the conductive planar element 407 so that its tip comes into contact with the transmission line 403 that is coupled to the antenna port of the duplex filter 402. The grounding pin 412 is long enough to make its tip come into contact with the conductive planar element 407 so that together the pins form the necessary feeding and grounding contacts required by the PIFA structure. The conductive planar element 407 has been pushed against the upper edge of the conductive frame 404 so that the contact springs 406 are slightly bent towards the printed circuit board. The elasticity of the contact springs causes a spring force that continuously presses the springs against the conductive planar element 407 ensuring good electrically conducting contact therebetween.

Figure 6:
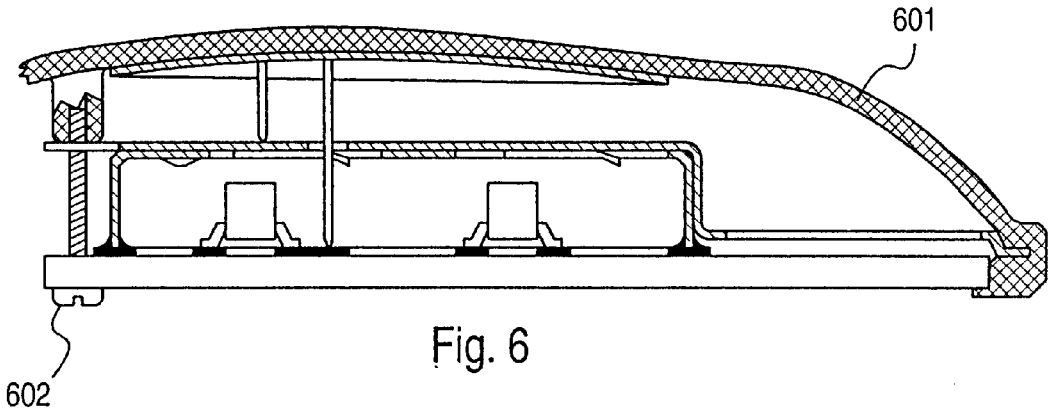
FIG. 6 illustrates the position of the structure shown in FIG. 5 in a mobile telephone.
Figure 7:
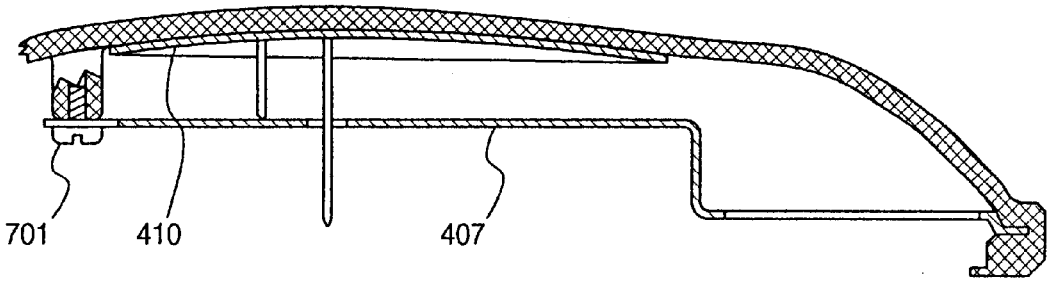
FIG. 7 illustrates a potential sub-assembly stage of the structure shown in FIG. 6

FIG. 6 shows the attachment of the structural aggregate of FIG. 5 into an outer cover part 601 of a mobile telephone. One end of the outer cover part defines pockets designed to receive the edge of the printed circuit board 401 and the coupling lip 408 at the end of the conductive planar element 407. The planar antenna radiator 410 has been glued onto the inner surface of the outer cover part 601, and a screw 602 keeps the whole stack consisting of the printed circuit board 401, the conductive frame 404, the conductive planar element 407 and the outer cover part 601 together.

Regarding the arrangement shown in FIG. 6, it is typical that a subcontractor provides the antennas to a mobile telephone manufacturer. In order to finely tune each antenna and to ensure that only properly working antennas are delivered to the mobile telephone manufacturer, the subcontractor should be able to set up a testing arrangement where a separately manufactured antenna can be tested in realistic conditions. The invention makes it possible that at the end of the antenna manufacturing process the subcontractor pre-assembles each mobile telephone cover part 601 into the form shown in FIG. 7 by attaching the planar antenna radiator 410 onto its inner surface and placing the conductive planar element 407 next to it. Temporary, detachable attachment means 701 may be used if required to secure the connections and/or to imitate the presence of corresponding attachment means in the final structure (a metallic screw in the close vicinity of the edge of the antenna radiator may have an effect on the antenna characteristics). In such a configuration the antenna is ready for final testing in very realistic conditions.

Figure 8:
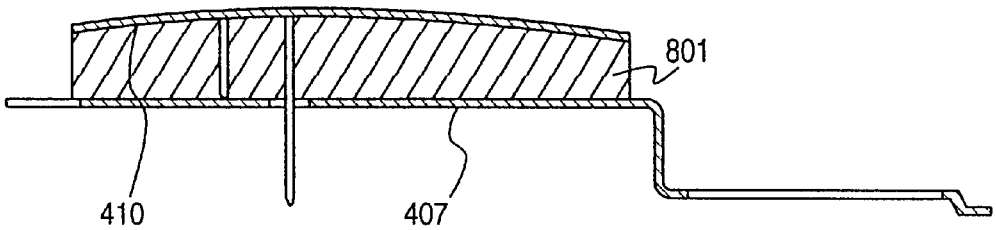
FIG. 8 illustrates an alternative to the structure shown in FIG. 7.

If the mechanical support of the planar antenna radiator is provided through some other means than an outer cover part, the second embodiment of the invention becomes even simpler making it even easier to outsource the manufacturing and testing of antennas. FIG. 8 illustrates a simple electromechanical structure where a dielectric support frame or a continuous dielectric layer 801 is used both to keep the planar antenna radiator 410 separated from the conductive planar element 407 next to it and to attach the parts together. The structural aggregate of FIG. 7 may be manufactured and tested separately from any other parts of the portable radio device.

The above-given embodiments of the invention are exemplary and should not be construed as placing limitations to the applicability of the appended claims. For example, although the foregoing description focuses on the applicability of the invention in portable radio transceivers like mobile telephones, the structure according to the invention is also applicable to receivers without own transmitter, like one-way pagers. In the foregoing description the feeding and grounding pins have been described as being located within the circumference of the conductive frame that defines the outer edge of the EMC shielding enclosure, but also such embodiments of the invention are possible where one or both of the pins are located outside the area defined by the EMC shielding enclosure. For example, the transmission line which is coupled to the duplex filter or other component closest to the antenna in the signal propagation sense may extend therefrom to the outside of the EMC shielding enclosure, so that the feeding pin either does not need to go through the conductive planar element at all or it goes through it at a point that is not within the portion serving as a lid to the EMC shielding enclosure. Similarly the grounding pin may come into contact with any point of the conductive planar element. The invention does not even require that the conductive planar element is separate from the conducting frame with which it constitutes the EMC shielding enclosure: it is possible to manufacture the whole EMC shielding structure as a single integral cover with relatively high edges at its sides and a hole for the antenna feeding pin. However, such an embodiment of the invention does not have the advantages of easy serviceability of the components inside the EMC shielding structure or easily arranged testing arrangement for the antenna.

What is claimed is:

1. An electromechanical structure for a portable radio device, comprising:

a circuit board, a number of components attached to the circuit board, a conductive shield for enclosing the components, and an essentially planar antenna radiator;

wherein the conductive shield comprises, as separate parts, a conductive frame attached to the circuit board and a conductive planar element to cover said conductive frame, of which said conductive planar element constitutes a part of the conductive shield which is essentially planar and adjacent to the antenna radiator in order to function as a ground plane for the antenna radiator.

2. An electromechanical structure according to claim 1, comprising means for establishing an electrically conductive multipoint contact between said conductive frame and said conductive planar element through a detachable mechanical joint between said conductive frame and said conductive planar element.

3. An electromechanical structure according to claim 2, wherein said means for establishing an electrically conductive multipoint contact comprise a number of contact springs formed as integral parts of that edge of said conductive frame which is farther from the printed circuit board.

4. An electromechanical structure according to claim 1, wherein the conductive shield defines a hole therethrough and the electromechanical structure further comprises a feeding pin and a grounding pin;

of which said feeding pin extends through said hole between the planar antenna radiator and a point coupled to at least one of the components attached to the circuit board, and said grounding pin extends between the planar antenna radiator and the conductive shield.

5. An electromechanical structure according to claim 1, further comprising an outer cover part and means for attaching to said outer cover part, the planar antenna radiator and that part of the conductive shield which is essentially planar and adjacent to the antenna radiator.

6. An electromechanical structure for. a portable radio device, comprising:

an outer cover part, an essentially planar antenna radiator, an essentially planar conductive element adjacent to the antenna radiator in order to function as a ground plane for the antenna radiator; wherein the essentially planar antenna radiator and the essentially planar conductive element are both situated inside the outer cover part, and the essentially planar conductive element is additionally arranged to function as a part of a conductive shield for enclosing certain electronic components of the portable radio device into an EMC shielding enclosure.

7. An electromechanical structure according to claim 6, further comprising means for attaching to said outer cover part, the planar antenna radiator and the essentially planar conductive element.

8. An electromechanical structure according to claim 6, further comprising dielectric means for attaching the planar antenna radiator and the essentially planar conductive element to each other.

* * * * *